US010720114B2

(12) United States Patent
Choi et al.

(10) Patent No.: US 10,720,114 B2
(45) Date of Patent: Jul. 21, 2020

(54) DISPLAY APPARATUS AND METHOD OF DRIVING THE SAME

(71) Applicant: Samsung Display Co., Ltd., Yongin-Si, Gyeonggi-Do (KR)

(72) Inventors: Nam-gon Choi, Yongin-si (KR); Jonghyun Lee, Cheonan-si (KR); WonJin Seo, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/104,294

(22) Filed: Aug. 17, 2018

(65) Prior Publication Data

US 2019/0057661 A1 Feb. 21, 2019

(30) Foreign Application Priority Data

Aug. 18, 2017 (KR) ..... 10-2017-0104986

(51) Int. Cl.
*G09G 3/36* (2006.01)
*G09G 3/20* (2006.01)

(52) U.S. Cl.
CPC ..... *G09G 3/3607* (2013.01); *G09G 3/2092* (2013.01); *G09G 3/3611* (2013.01); *G09G 2320/029* (2013.01); *G09G 2320/0242* (2013.01); *G09G 2320/0666* (2013.01); *G09G 2340/0435* (2013.01); *G09G 2340/06* (2013.01); *G09G 2370/08* (2013.01)

(58) Field of Classification Search
CPC ... G09G 2320/0242; G09G 2320/0276; G09G 2320/0285; G09G 2320/029; G09G 2340/06; G09G 2370/08; G09G 3/3413; G09G 2320/02; H04N 9/646; H04N 1/32101; G06F 17/40; G06F 3/005
See application file for complete search history.

(56) References Cited

U.S. PATENT DOCUMENTS 6,323,871 B1 11/2001 Fujiyoshi et al.
8,681,083 B2 3/2014 Kang et al.
9,262,987 B2 2/2016 Albrecht et al.
(Continued)

FOREIGN PATENT DOCUMENTS

KR 101774127 B1 9/2017
KR 1020180018898 A 2/2018

*Primary Examiner* — Gerald Johnson
(74) *Attorney, Agent, or Firm* — Cantor Colburn LLP

(57) ABSTRACT

A display apparatus includes a display, a frequency compensator, a frequency adjuster, and a driver. The display includes first, second, and third pixels to display an image having color information. The frequency compensator receives first, second, and third pixel data respectively corresponding to the first, second, and third pixels, converts the first, second, and third pixel data to hue data, and outputs a frequency control signal to change a current driving frequency of the display based on the hue data. The frequency adjuster changes the driving frequency to a predetermined compensation frequency in response to the frequency control signal and changes a frequency of image data and an image control signal such that the display is driven at the predetermined compensation frequency. The driver receives the changed image data and the changed image control signal and drives the display at the predetermined compensation frequency.

20 Claims, 9 Drawing Sheets

(56) References Cited

U.S. PATENT DOCUMENTS

| | | | | |
|---|---|---|---|---|
| 9,318,069 | B2 | 4/2016 | Nambi et al. | |
| 2016/0027363 | A1* | 1/2016 | Lee | G09G 3/2003 345/691 |
| 2016/0093239 | A1 | 3/2016 | Wang et al. | |
| 2016/0284285 | A1* | 9/2016 | Verstraete | G02F 1/133603 |
| 2017/0053578 | A1* | 2/2017 | Chen | G09G 3/2003 |

* cited by examiner

DISPLAY APPARATUS AND METHOD OF DRIVING THE SAME

This application claims priority to Korean Patent Application No. 10-2017-0104986, filed on Aug. 18, 2017, and all the benefits accruing therefrom under 35 U.S.C. § 119, the content of which in its entirety is herein incorporated by reference.

BACKGROUND

1. Field

Exemplary embodiments of the invention relate to a display apparatus and a method of driving the same. More particularly, exemplary embodiments of the invention relate to a display apparatus improving a color uniformity and a method of driving the display apparatus.

2. Description of the Related Art

A liquid crystal display ("LCD") apparatus forms an electric field in a liquid crystal layer disposed between two substrates to change an alignment of liquid crystal molecules and to control a transmittance of a light incident thereto, thereby displaying an image.

In general, the LCD apparatus uses three primary colors, e.g., red, green, and blue colors, to display a color. Accordingly, an LCD panel includes unit pixels each including three pixels respectively corresponding to the red, green, and blue colors, and the color formed by a combination of the three pixels is displayed as a representative color of the unit pixel.

SUMMARY

In recent years, since a liquid crystal display ("LCD") apparatus employs a high resolution structure, a structure that reduces a number of driving chips, and a high-frequency driving structure, a time desired to drive each pixel is reduced, and as a result, a charge rate of each pixel is reduced. A reduction of the charge rate of the pixels causes a non-uniformity in color of the image displayed through the LCD apparatus.

Exemplary embodiments of the invention provide a display apparatus capable of improving a color non-uniformity caused by a reduction of charge rate.

Exemplary embodiments of the invention provide a method of driving the display apparatus.

Exemplary embodiments of the invention provide a display apparatus including a display, a frequency compensator, a frequency adjuster, and a driver.

The display includes first, second, and third pixels to display an image having color information. The frequency compensator receives first, second, and third pixel data respectively corresponding to the first, second, and third pixels, converts the first, second, and third pixel data to hue data, and outputs a frequency control signal to change a current driving frequency of the display based on the hue data. The frequency adjuster changes the current driving frequency to a predetermined compensation frequency in response to the frequency control signal and changes a frequency of image data and an image control signal to output the changed image data and the changed image control signal such that the display is driven at the predetermined compensation frequency. The driver receives the changed image data and the changed image control signal and drives the display at the predetermined compensation frequency.

Exemplary embodiments of the invention provide a method of driving a display apparatus, which includes a display including first, second, and third pixels to display an image having color information, including receiving first, second, and third pixel data respectively corresponding to the first, second, and third pixels to convert the first, second, and third data to hue data, outputting a frequency control signal to change a current driving frequency of the display based on the hue data, changing the current driving frequency to a predetermined compensation frequency in response to the frequency control signal, changing a frequency of image data and an image control signal to output the changed image data and the changed image control signal such that the display is driven at the compensation frequency, and receiving the changed image data and the changed image control signal to drive the display at the compensation frequency.

According to the above, the hue data are calculated based on the pixel data including the color information, and the driving frequency is changed using the hue data when the image having poor color uniformity is driven. Thus, the overall color uniformity of the display apparatus may be improved.

BRIEF DESCRIPTION OF THE DRAWINGS

The above and other advantages of the invention will become readily apparent by reference to the following detailed description when considered in conjunction with the accompanying drawings, in which.

DETAILED DESCRIPTION

Figure 1:
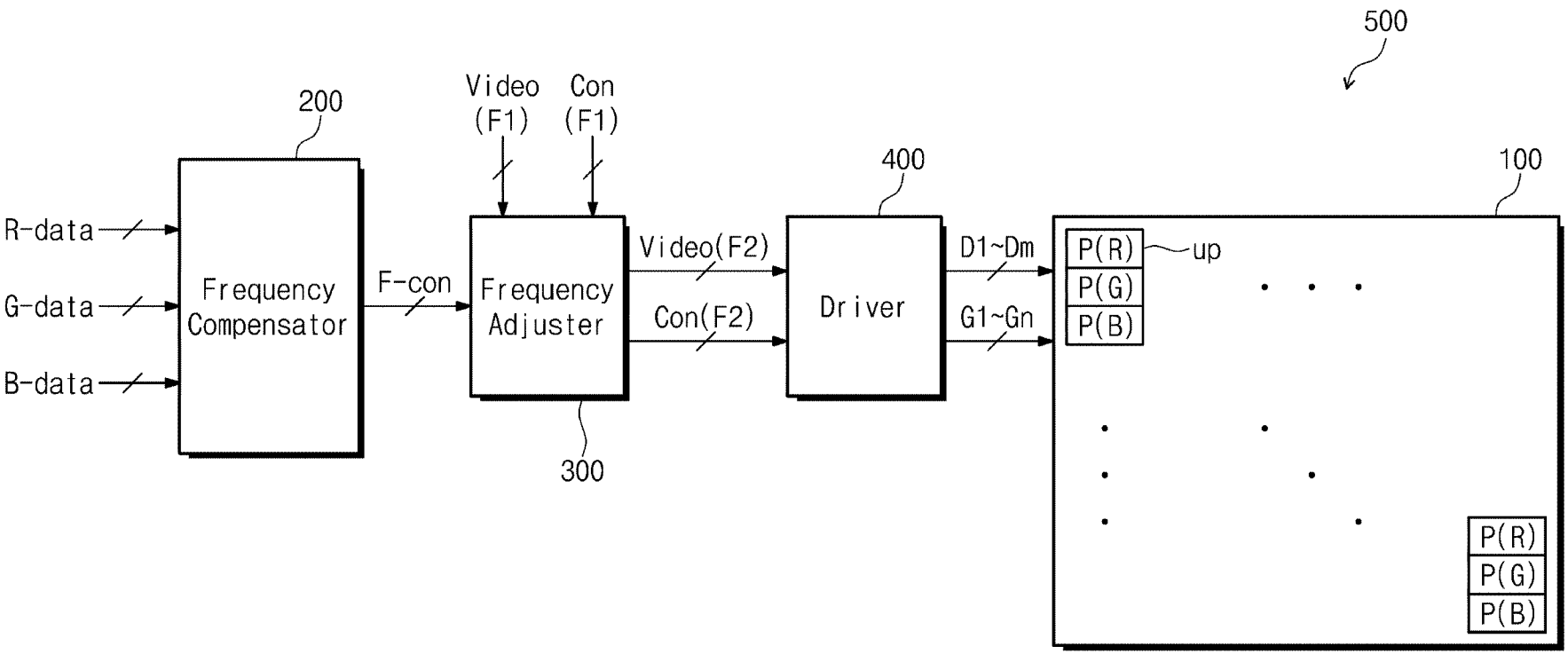
FIG. 1 is a block diagram showing an exemplary embodiment of a display apparatus according to the invention.

The invention may be variously modified and realized in many different forms, and thus specific embodiments will be exemplified in the drawings and described in detail hereinbelow. However, the invention should not be limited to the specific disclosed forms, and be construed to include all modifications, equivalents, or replacements included in the spirit and scope of the invention.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram showing a display apparatus 500 according to an exemplary embodiment of the invention.

Referring to FIG. 1, the display apparatus 500 includes a display 100, a frequency compensator 200, a frequency adjuster 300, and a driver 400.

The display 100 includes a plurality of unit pixels UP. Each of the unit pixels UP includes first, second, and third pixels P(R), P(G), and P(B) and displays an image having color information.

In the illustrated exemplary embodiment, the first, second, and third pixels P(R), P(G), and P(B) display one of red, green, and blue colors, and the first, second, and third pixels P(R), P(G), and P(B) display different colors from each other. However, a kind of colors displayed by each of the first, second, and third pixels P(R), P(G), and P(B) should not be limited thereto or thereby.

In addition, the number of the pixels included in each of the unit pixels UP should not be limited thereto or thereby. That is, each of the unit pixels UP may include four or more pixels.

The frequency compensator 200 may receive first, second, and third pixel data R-data, G-data, and B-data respectively corresponding to the first, second, and third pixels P(R), P(G), and P(B). The frequency compensator 200 converts the first, second, and third pixel data R-data, G-data, and B-data to hue data H-data (refer to FIG. 2) and outputs a frequency control signal F-con based on the hue data H-data to change a driving frequency F1.

In FIG. 1, the frequency compensator 200 receives the first, second, and third pixel data R-data, G-data, and B-data, but it should not be limited thereto or thereby. In an exemplary embodiment, in a case that the unit pixel UP includes four or more pixels, the frequency compensator 200 may receive four or more pixel data corresponding to the four or more pixels, respectively, for example.

The frequency adjuster 300 may receive image data Video(F1) and an image control signal Con(F1), which are desired to drive the display 100, in synchronization with a driving frequency F1.

The frequency control signal F-con output from the frequency compensator 200 is applied to the frequency adjuster 300. The frequency control signal F-con may include information that determines whether the display 100 decreases or increases a currently-driving frequency (hereinafter, referred to as a "driving frequency F1"). In addition, the frequency control signal F-con may further include information on how to set a rate of decrease or increase of the driving frequency F1.

The frequency adjuster 300 changes the driving frequency F1 to a compensation frequency F2 based on the information included in the frequency control signal F-con and converts the image data Video(F1) and the image control signal Con(F1) to a signal synchronized with the compensation frequency F2 to output the signal.

Although not shown in FIG. 1, the frequency adjuster 300 may further include a storing unit to store the compensation frequency F2. Accordingly, the frequency adjuster 300 may recognize the compensation frequency F2 stored therein as the current-driving frequency of the display 100 in a next frame.

The driver 400 receives the image data Video(F2) and the image control signal Con(F2) in synchronization with the compensation frequency F2. The driver 400 outputs data signals D1 to Dm and gate signals G1 to Gn based on the image data Video(F2) and the image control signal Con(F2) to drive the display 100. Here, n and m are natural numbers.

Although not shown in FIG. 1, the driver 400 may include a data driver to generate the data signals D1 to Dm and a gate driver to generate the gate signals G1 to Gn. In addition, the driver 400 may further include a timing controller to control a drive of the data driver and the gate driver.

The display 100 receives the data signals D1 to Dm and the gate signals G1 to Gn to display the image at the compensation frequency F2.

As an example of the invention, the display 100 may be, but not limited to, a liquid crystal panel including a lower substrate, an upper substrate facing the lower substrate, and a liquid crystal layer disposed between the lower and upper substrates. Although not shown in FIG. 1, the display 100 may further include a plurality of gate lines receiving the gate signals G1 to Gn and a plurality of data lines receiving the data signals D1 to Dm.

Each of the first, second, and third pixels P(R), P(G), and P(B) is connected to a corresponding gate line and a corresponding data line and receives corresponding gate and data signals to display the image. The representative color of the unit pixel UP may be determined by the combination of the first, second, and third pixels P(R), P(G), and P(B).

A time desired to drive the unit pixel UP may be shortened depending on a driving method and a pixel arrangement of the display apparatus 500. In this case, a time used to drive each of the first, second, and third pixels P(R), P(G), and P(B) is reduced, and as a result, the first, second, and third pixels P(R), P(G), and P(B) may not be sufficiently charged. Accordingly, since the representative color of the unit pixel UP does not have desired characteristics, the color non-uniformity may occur.

In this case, the charge rate of each of the first, second, and third pixels P(R), P(G), and P(B) may be compensated by compensating for the driving frequency used to drive the display 100, i.e., by reducing the frequency used to drive the display 100. When the charge rate of each of the first, second, and third pixels P(R), P(G), and P(B) is compensated, the color non-uniformity caused by an insufficient charge rate may be improved.

As an example of the invention, each of the first, second, and third pixels P(R), P(G), and P(B) shown in FIG. 1 has a structure (i.e., a horizontal pixel structure) in which a horizontal width is greater than a vertical width. In an exemplary embodiment, the horizontal width of each of the first, second, and third pixels P(R), P(G), and P(B) is three times greater than the vertical width of each of the first, second, and third pixels P(R), P(G), and P(B), for example.

Since each of the first, second, and third pixels P(R), P(G), and P(B) in the horizontal pixel structure is driven during one-third (⅓) of the time desired to drive one unit pixel, the time desired to charge each of the first, second, and third pixels P(R), P(G), and P(B) may be reduced compared to that of the vertical pixel structure. That is, the color non-uniformity caused by the reduction of the charge rate may occur in the horizontal pixel structure. In this case, the occurrence of the color non-uniformity caused by the reduction of the charge rate may be prevented by employing the driving frequency compensation method.

The driving frequency compensation method may be applied not only to the display apparatus employing the horizontal pixel structure but also to display apparatuses employing the driving method and structure in which the charging time of the pixel is reduced to improve the color non-uniformity.

Figure 2:
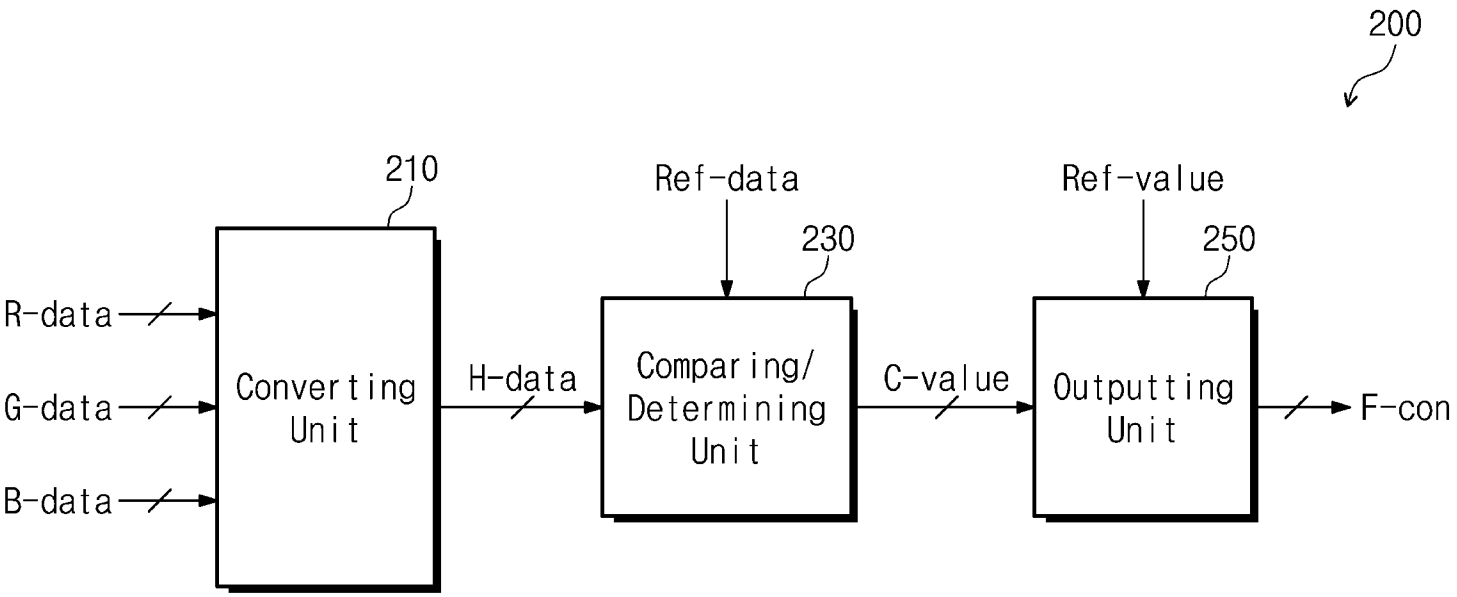
FIG. 2 is a block diagram showing a frequency compensator shown in FIG. 1.
Figure 3:
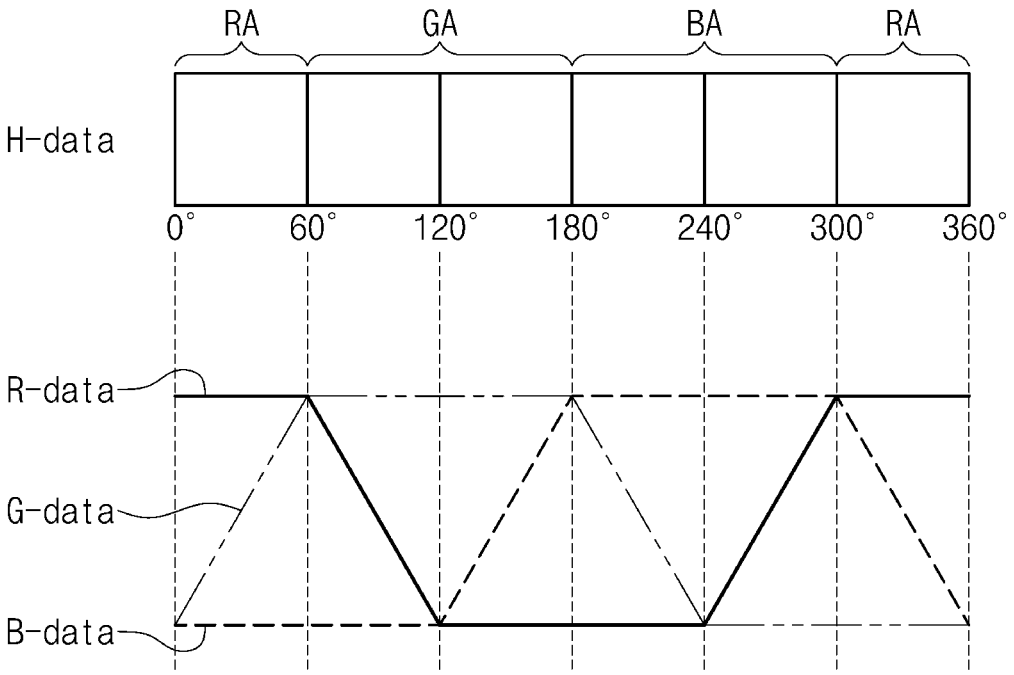
FIG. 3 is a view showing a process of converting first to third pixel data shown in FIG. 2 to hue data.

FIG. 2 is a block diagram showing the frequency compensator 200 shown in FIG. 1, and FIG. 3 is a view showing a process of converting the first to third pixel data shown in FIG. 2 to the hue data.

Referring to FIG. 2, the frequency compensator 200 includes a converter 210, a comparing/determining unit 230, and an outputting unit 250. The converter 210 converts the first, second, and third data R-data, G-data, and B-data to the hue data H-data.

Referring to FIG. 3, for the convenience of explanation, the first, second, and third data R-data, G-data, and B-data are represented by values from 0 to 1 depending on their grayscale level. In an exemplary embodiment, in a case that the first, second, and third data R-data, G-data, and B-data are represented by 256 grayscale levels, grayscale values from 0 to 255 may be converted to and represented by the values from 0 to 1, for example. The hue data H-data may be generated based on the size and ratio of the first, second, and third data R-data, G-data, and B-data.

As an example of the invention, the hue data H-data may include a value representing a color. The color may be determined by the ratio of the first, second, and third data R-data, G-data, and B-data. The hue data H-data may be divided into red, green, and blue areas RA, GA, and BA. The red area RA is an area in which the ratio of the first pixel data R-data is relatively greater than that of the second and third pixel data G-data and B-data, and the green area GA is an area in which the ratio of the second pixel data G-data is relatively greater than that of the first and third pixel data R-data and B-data. In addition, the blue area BA is an area in which the ratio of the third pixel data B-data is relatively greater than that of the first and second pixel data R-data and G-data.

As an example of the invention, when the red, green, and blue areas RA, GA, and BA are matched to a hue scale, the red area RA corresponds to an area including a range from about 0 degree (°) to about 60° of the hue scale and a range from about 300° to about 360° of the hue scale, the green area GA corresponds to an area including a range from about 60° to about 180° of the hue scale, and the blue area BA corresponds to an area including a range from about 180° to about 300° of the hue scale.

Although not shown in drawing figures, the hue data H-data may further include chroma information and brightness information generated based on the grayscale level of the first, second, and third data R-data, G-data, and B-data in addition to the color information.

Referring back to FIG. 2, the comparing/determining unit 230 receives the hue data H-data from the converter 210 and compares the received hue data H-data to predetermined reference data Ref-data. In a case that the hue data H-data include only the color information, the reference data Ref-data include reference information on the color. However, in a case that the hue data H-data include two or more information, such as the color information and the chroma information, the color information and the brightness information, etc., the reference data Ref-data further include reference information on the chroma and the brightness.

In addition, the comparing/determining unit 230 may set a reference range using two reference data Ref-data. In an exemplary embodiment, in a case that the two reference data Ref-data are respectively set to 0° and 120°, the reference range may be set to a range from 0° to 120° (refer to FIG. 3), for example.

The comparing/determining unit 230 determines whether the hue data H-data exists in the reference range. According to the compared result, the comparing/determining unit 230 counts up the number of the hue data H-data existing in the reference range. In an exemplary embodiment, the comparing/determining unit 230 may count up the number of the hue data H-data existing in the reference range among the hue data H-data generated based on data of one frame, for example.

In the above descriptions, one reference range is set in the comparing/determining unit 230 as an example, but the number of the reference ranges should not be limited to one. That is, according to another exemplary embodiment, two or more reference ranges may be set in the comparing/determining unit 230. In another exemplary embodiment, an area from 0° to 120° may be set to a first reference range, and an area from 240° to 300° may be set to a second reference range, for example. In this case, the comparing/determining unit 230 may count up the number of the hue-data existing in each of the first and second reference ranges.

The comparing/determining unit 230 provides the counted result value, i.e., a counted value C-value, to the outputting unit 250. In the case that one reference range is set, the comparing/determining unit 230 outputs one counted value. However, in the case that two or more reference ranges are set, the comparing/determining unit 230 may output counted values respectively corresponding to the reference ranges.

The outputting unit 250 compares the counted value C-value to the predetermined reference value Ref-value. According to the compared result, in a case that the counted value C-value is equal to or greater than the reference value Ref-value, the outputting unit 250 may output the frequency control signal F-con to change the driving frequency.

In the case that the number of the reference ranges is one, one reference value Ref-value is set in the outputting unit 250, but in the case that the number of the reference ranges is two or more, different reference values Ref-value from each other may be set in the outputting unit 250 to respectively correspond to the reference ranges. In addition, outputting unit 250 may output different frequency control signals from each other to change the driving frequency to different compensation frequencies from each other depending on each of the reference ranges.

In an exemplary embodiment, in a case that the counted value C-value of the hue data H-data existing in the first reference range from 60° to 120° is greater than the reference value Ref-value (i.e., a first case), the driving frequency may be changed to a first compensation frequency, for example. In addition, in a case that the counted value C-value of the hue data H-data existing in the second reference range from 240° to 300° is greater than the reference value Ref-value (i.e., a second case), the driving frequency may be changed to a second compensation frequency. When both of the first case and the second case occur, the driving frequency may be changed to an average value of the first and second compensation frequencies.

Figure 4:
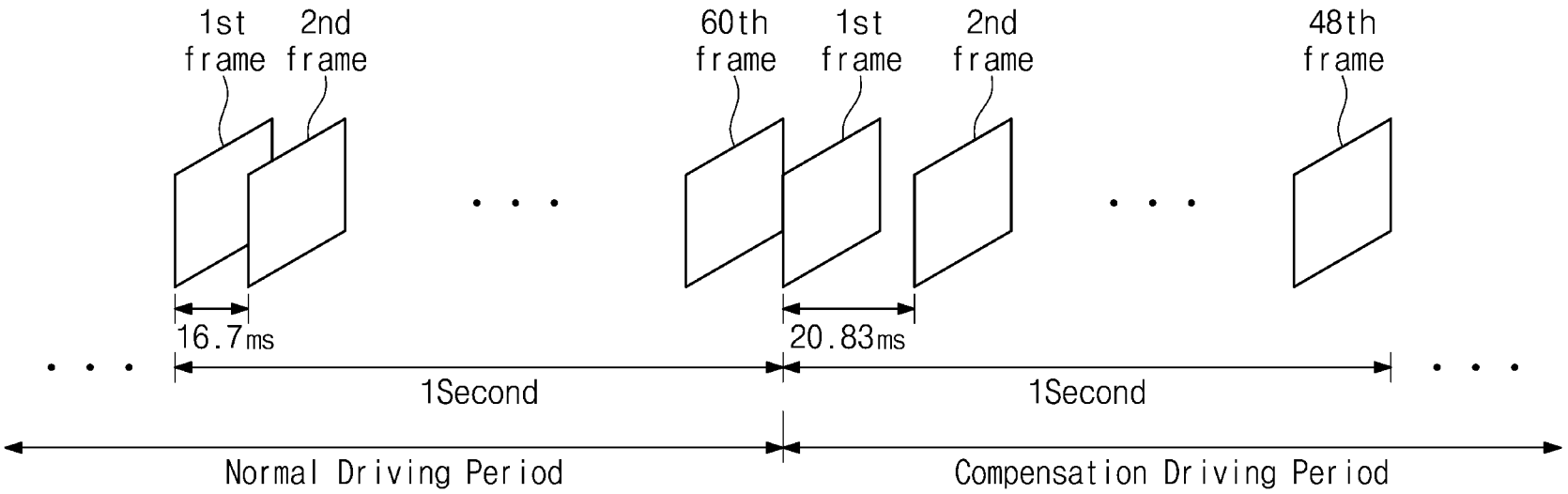
FIG. 4 is a view showing a normal driving period and a compensation driving period.

FIG. 4 is a view showing a normal driving period and a compensation driving period.

Here, the normal driving period corresponds to a period in which the display 100 (refer to FIG. 1) is driven at the driving frequency F1 set in the display apparatus 500 (refer to FIG. 1), and the compensation driving period corresponds to a period in which the display 100 is driven at the compensation frequency F2.

Referring to FIG. 4, in an exemplary embodiment, the driving frequency F1 is about 60 Hertz (Hz), and the compensation frequency F2 is about 48 Hz, for example. The driving frequency F1 and the compensation frequency F2 should not be limited thereto or thereby.

The display 100 is driven at 60 Hz during the normal driving period. Accordingly, 60 frames are displayed during a period of about a second, and a period in which one frame is displayed is about 16.7 milliseconds (ms). The display 100 is driven at a frequency lower than 60 Hz, e.g., at 48 Hz during the compensation driving period. Accordingly, 48 frames are displayed during a period of about a second, and a period in which one frame is displayed is about 20.83 ms.

As described above, when the frequency at which the display 100 is driven is reduced to about 48 Hz from about 60 Hz, the time desired to display one frame increases, and the charging time of each of the pixels increases. As a result, the color non-uniformity caused by the insufficient of the charge rate may be improved.

Figure 5:
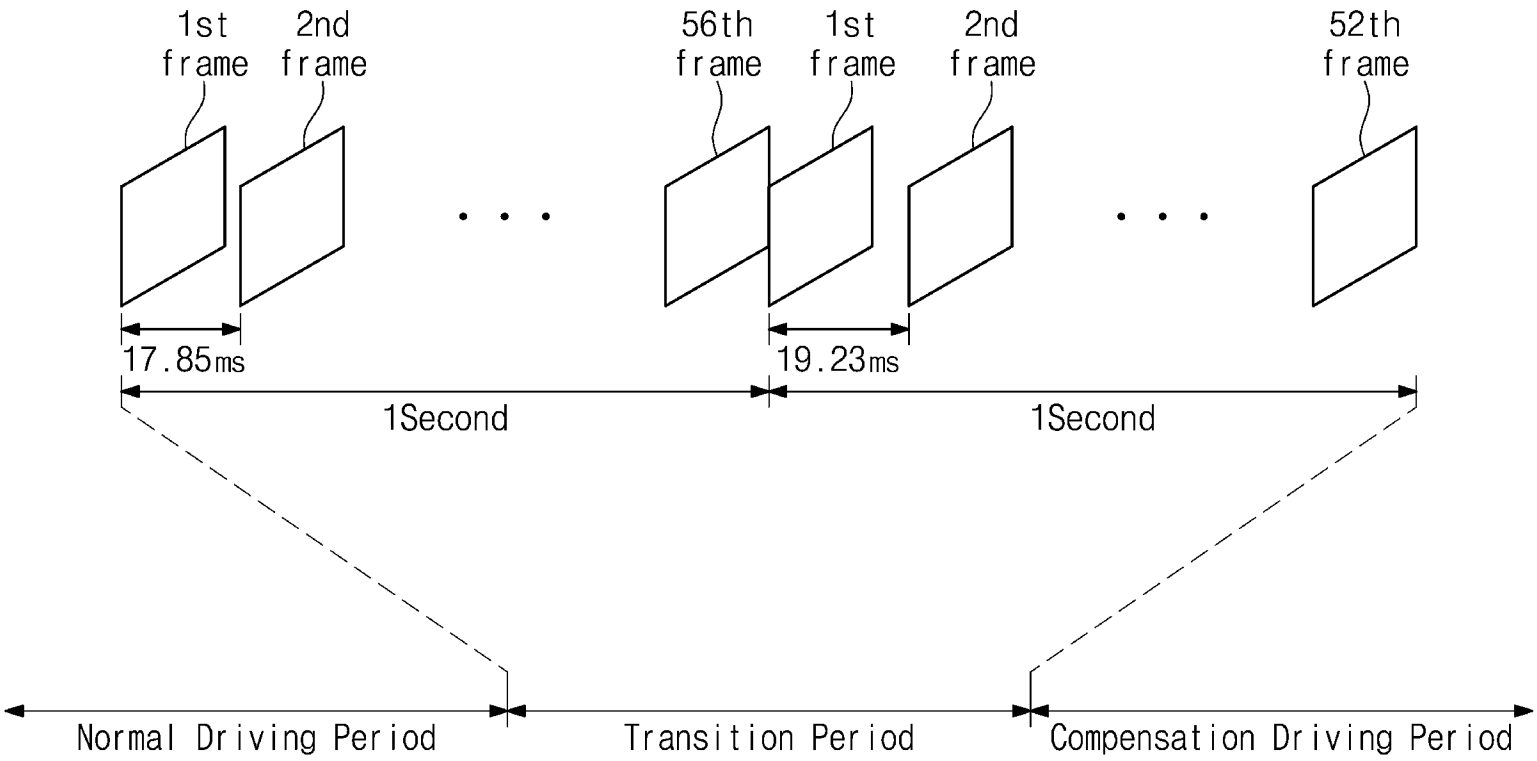
FIG. 5 is a view showing a transition period between the normal driving period and the compensation driving period.

FIG. 5 is a view showing a transition period between the normal driving period and the compensation driving period.

Referring to FIG. 5, the transition period may be further defined between the normal driving period and the compensation driving period as another example of the invention. For the convenience of explanation, a time for the transition period is set to two seconds in FIG. 5, but it should not be limited to two seconds.

The transition period is provided to allow the frequency to be changed stepwise to the compensation frequency F2 of the compensation driving period from the driving frequency F1 of the normal driving period. That is, the driving frequency F1 of the normal driving period is reduced stepwise to the compensation frequency F2 of the compensation driving period during the transition period. As an example, the transition period may be divided into a period in which the display 100 is driven at 56 Hz and a period in which the display 100 is driven at 52 Hz.

In FIG. 5, the frequency is changed in two steps during the transition period, but it should not be limited thereto or thereby. That is, the frequency may be changed in one step or three or more steps during the transition period.

Figure 6:
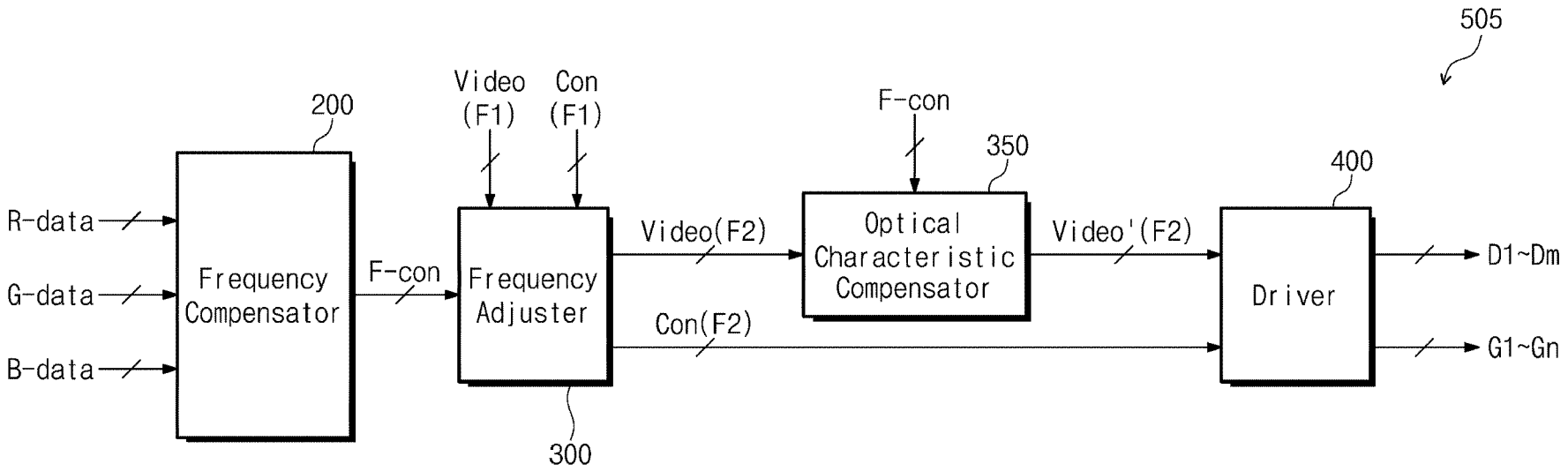
FIG. 6 is a block diagram showing another exemplary embodiment of a display apparatus according to the invention.

FIG. 6 is a block diagram showing a display apparatus 505 according to another exemplary embodiment of the invention. In FIG. 6, the same reference numerals denote the same elements in FIG. 1, and thus the detailed descriptions of the same elements will be omitted.

Referring to FIG. 6, the display apparatus 505 may further include an optical characteristic compensator 350. In FIG. 6, the display 100 is omitted, but the display apparatus 505 includes the display 100.

As an example, the optical characteristic compensator 350 may be disposed between the frequency adjuster 300 and the driver 400. The optical characteristic compensator 350 receives the image data Video(F2) in synchronization with the compensation frequency F2 and compensates for the optical characteristic of the image data Video(F2) to apply the compensated image data Video'(F2) to the driver 400.

The optical characteristic compensator 350 is desired to have information on the compensation frequency F2 such that the optical characteristic of the image data Video(F2) is compensated corresponding to the compensation frequency F2. Accordingly, the optical characteristic compensator 350 may receive the frequency control signal F-con from the frequency compensator 200. According to another exemplary embodiment, the optical characteristic compensator 350 may receive a separate control signal including information on the compensation frequency F2 from the frequency adjuster 300.

The driver 400 receives the compensated image data Video'(F2) and processes the compensated image data Video'(F2) to generate the data signals D1 to Dm. Accordingly, the display 100 (refer to FIG. 1) may prevent the optical characteristic from varying when the frequency is changed to the compensation frequency F2 by the optical characteristic compensator 350.

In FIG. 6, the optical characteristic compensator 350 is disposed between the frequency adjuster 300 and the driver 400 as a separate unit, but it should not be limited thereto or thereby. That is, according to another exemplary embodiment, the optical characteristic compensator 350 may be included in one of the frequency adjuster 300 and the driver 400.

Figure 7:
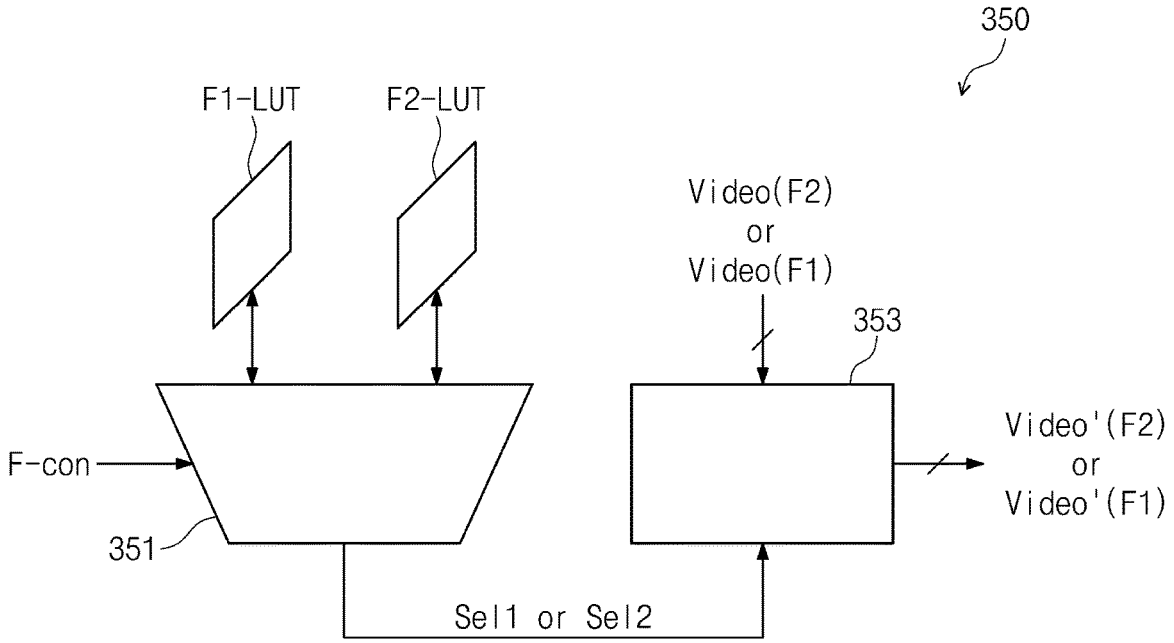
FIG. 7 is a block diagram showing an optical characteristic compensator shown in FIG. 6.

FIG. 7 is a block diagram showing the optical characteristic compensator 350 shown in FIG. 6.

Referring to FIG. 7, the optical characteristic compensator 350 includes a selector 351, first and second look-up tables F1-LUT and F2-LUT, and a compensator 353. The selector 351 receives the frequency control signal F-con and selects a look-up table corresponding to the frequency among the first and second look-up tables F1-LUT and F2-LUT in response to the frequency control signal F-con.

In a case that the frequency control signal F-con includes information that the driving frequency F1 is changed to the compensation frequency F2, the selector 351 may output a selection signal Sel1 to select the second look-up table F2-LUT among the first and second look-up tables F1-LUT and F2-LUT. Accordingly, the compensator 353 compensates for the image data Video(F2) with reference to the second look-up table F2-LUT in response to the selection signal Sel1, and then outputs the compensated image data Video'(F2).

Although not shown in FIG. 7, the frequency control signal F-con may include information to maintain the driving frequency F1 or to restore to the driving frequency F1 from the compensation frequency F2. In these cases, the selector 351 may output a selection signal Sel2 to select the first look-up table F1-LUT among the first and second look-up tables F1-LUT and F2-LUT.

The compensator 353 may receive the image data Video (F1) synchronized with the driving frequency F1 from the frequency adjuster 300. Accordingly, the compensator 353 compensates for the image data Video(F1) with reference to the first look-up table F1-LUT in response to the selection signal Sel2 and outputs the compensated image data Video' (F1).

FIG. 7 shows the optical characteristic compensator 350 corresponding to the exemplary embodiment of FIG. 4 in which the transition period is not defined between the normal driving period and the compensation driving period. However, in the case that the transition period is defined between the normal driving period and the compensation driving period as shown in FIG. 5, a configuration of the optical characteristic compensator 350 may be changed. That is, in the case that the frequency is changed stepwise during the transition period, the optical characteristic compensator 350 may further include a look-up table corresponding to a corresponding frequency, and the compensator 353 may compensate for the image data by taking into account the corresponding frequency.

Figure 8:
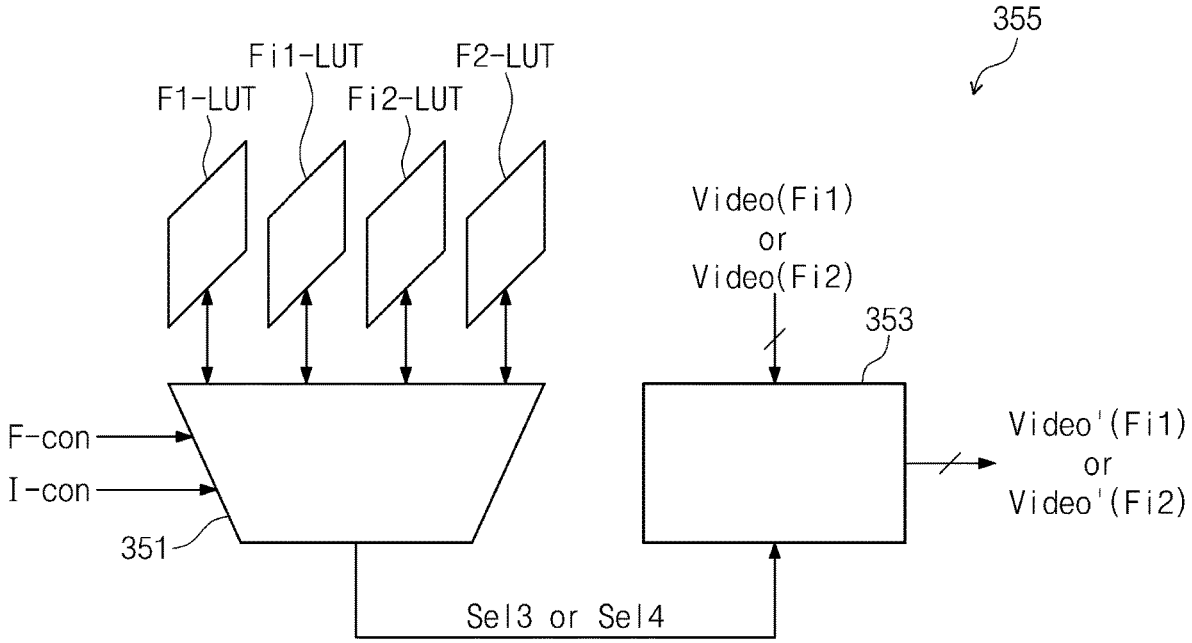
FIG. 8 is a block diagram showing another exemplary embodiment of an optical characteristic compensator according to the invention.

FIG. 8 is a block diagram showing an optical characteristic compensator 355 according to another exemplary embodiment of the invention.

FIG. 8 shows an example of the optical characteristic compensator 355 designed to correspond to the structure in which the frequency is changed in two steps during the transition period.

The display 100 (refer to FIG. 1) may be driven at a first transition frequency Fi1 during a former transition period of the transition period and driven at a second transition frequency Fi2 during a latter transition period of the transition period. In this case, the optical characteristic compensator 355 may further include a third look-up table Fi1-LUT corresponding to the first transition frequency Fi1 and a fourth look-up table Fi2-LUT corresponding to the second transition frequency Fi2.

Accordingly, the selector 351 may further receive a control signal I-con including information on the transition period and the first and second transition frequencies Fi1 and Fi2 in addition to the frequency control signal F-con.

The selector 351 may output a selection signal Sel3 to select the third look-up table Fi1-LUT of the third and fourth look-up tables Fi1-LUT and Fi2-LUT during the former transition period. Although not shown in FIG. 8, the frequency adjuster 300 (refer to FIG. 6) changes the driving frequency to the first transition frequency Fi1 and converts the image data Video(F1) and the image control signal Con(F1) to signals synchronized with the first transition frequency Fi1 to output the signals synchronized with the first transition frequency Fi1.

Accordingly, the compensator 353 may receive the image data Video(Fi1) synchronized with the first transition frequency Fi1 from the frequency adjuster 300 during the former transition period. The compensator 353 compensates for the image data Video(Fi1) in response to the selection signal Sel3 with reference to the third look-up table Fi1-LUT and outputs the compensated image data Video'(Fi1).

Although not shown in FIG. 8, the frequency adjuster 300 changes the driving frequency to the second transition frequency Fi2 and converts the image data Video(F1) and the image control signal Con(F1) to signals synchronized with the second transition frequency Fi2 to output the signals synchronized with the second transition frequency Fi2.

Accordingly, the compensator 353 may receive the image data Video(Fi2) synchronized with the second transition frequency Fi2 from the frequency adjuster 300 during the latter transition period. The compensator 353 compensates for the image data Video(Fi2) in response to the selection signal Sel4 with reference to the fourth look-up table Fi2-LUT and outputs the compensated image data Video'(Fi2).

Figure 9:
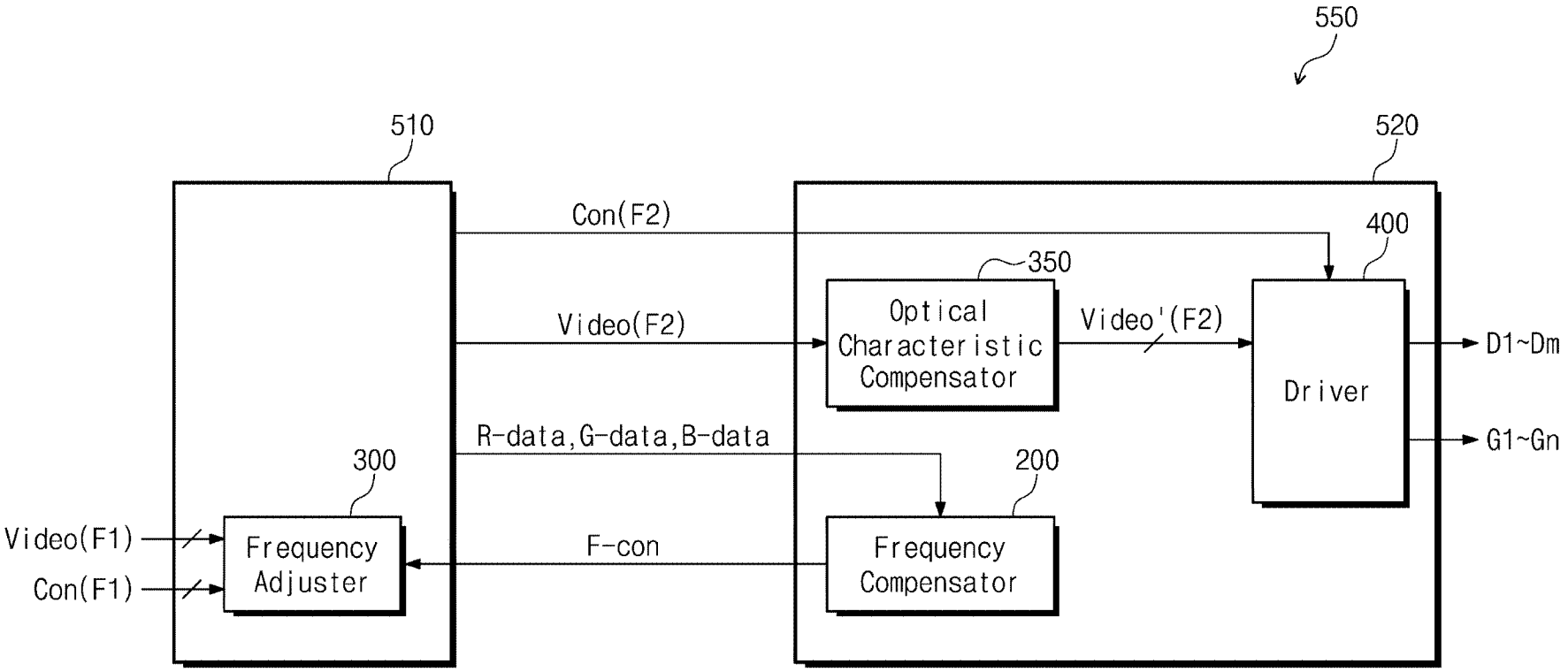
FIG. 9 is a schematic view showing an exemplary embodiment of a display apparatus according to the invention.

FIG. 9 is a schematic view showing a display apparatus 550 according to an exemplary embodiment of the invention.

Referring to FIG. 9, the display apparatus 550 includes a main board 510 and a display board 520.

The main board 510 may provide an interface to connect the display apparatus 550 to external peripheral devices (not shown). Accordingly, the main board 510 receives various control signals and image signals from the external peripheral devices to drive the display 100 (refer to FIG. 1).

The display board 520 is connected to the main board 510 to receive the various control signals and the image signals. The display board 520 includes various circuits to convert the signals received through the main board 510 to control signals desired to drive the display 100 and image signals appropriate to drive the display 100.

As an example, the frequency adjuster 300 may be included in the main board 510, and the frequency compensator 200 and the optical characteristic compensator 350 may be included in the display board 520.

In FIG. 9, the driver 400 is included in the display board 520. However, according to another exemplary embodiment, some circuits, e.g., the timing controller, of circuits of the driver 400 may be included in the display board 520. In this case, the other circuits, e.g., the data driver, the gate driver, etc., of the driver 400 may be mounted (e.g., disposed) on the liquid crystal panel of the display 100 in an integrated circuit (IC) form or built-in in the liquid crystal panel.

Figure 10:
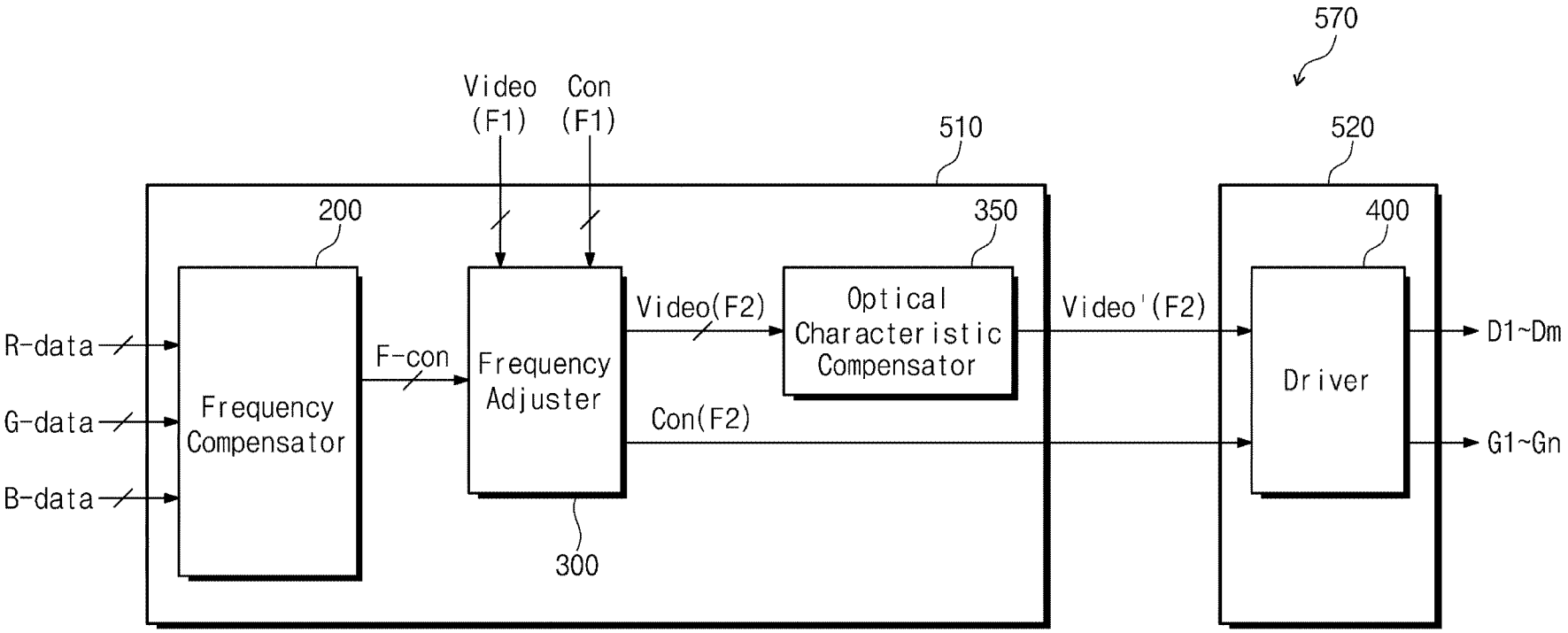
FIG. 10 is a schematic view showing another exemplary embodiment of a display apparatus according to the invention.

FIG. 10 is a schematic view showing a display apparatus 570 according to another exemplary embodiment of the invention.

Referring to FIG. 10, the display apparatus 570 includes a frequency compensator 200, frequency adjuster 300, an optical characteristic compensator 350, and a driver 400. The frequency compensator 200, the frequency adjuster 300, and the optical characteristic compensator 350 may be disposed in a main board 510 of the display apparatus 570, and the driver 400 may be disposed in a display board 520 of the display apparatus 570.

Different from those structures shown in FIGS. 9 and 10, a structure in which the frequency compensator 200, the frequency adjuster 300, the optical characteristic compensator 350, and the driver 400 are disposed in the display board 520 may be implemented.

In addition, according to another exemplary embodiment, a structure in which the frequency compensator 200 is disposed in the main board 510 and the frequency adjuster 300, the optical characteristic compensator 350, and the driver 400 are disposed in the display board 520 may be implemented.

Further, positions of the frequency compensator 200, the frequency adjuster 300, the optical characteristic compensator 350, and the driver 400 may be changed as needed when the display apparatus is designed.

Although the exemplary embodiments of the invention have been described, it is understood that the invention should not be limited to these exemplary embodiments but various changes and modifications may be made by one ordinary skilled in the art within the spirit and scope of the invention as hereinafter claimed.

What is claimed is:

1. A display apparatus comprising:

a display comprising first, second, and third pixels to display an image comprising color information;

a frequency compensator which receives first, second, and third pixel data respectively corresponding to the first, second, and third pixels, converting the first, second, and third pixel data to hue data, and outputs a frequency control signal to change a current driving frequency (hereinafter, referred to as a driving frequency) of the display based on the hue data;

a frequency adjuster which changes the driving frequency to a predetermined compensation frequency in response to the frequency control signal and changes a frequency of image data and an image control signal to output the changed image data and the changed image control signal such that the display is driven at the predetermined compensation frequency; and a driver which receives the changed image data and the changed image control signal and drives the display at the predetermined compensation frequency, wherein the hue data is generated based on a ratio of the first, second, and third pixel data.

2. The display apparatus of claim 1, wherein the frequency compensator comprises:

a converter which converts the first, second, and third pixel data to the hue data;

a comparing/determining unit which compares the hue data to predetermined reference data and counts up a number of the hue data greater than the predetermined reference data; and an outputting unit which outputs the frequency control signal including a first information to change the driving frequency when the counted value is equal to or greater than a predetermined reference value.

3. The display apparatus of claim 2, wherein, when the counted value is equal to or greater than the predetermined reference value, the outputting unit outputs the frequency control signal to decrease the driving frequency, and the frequency adjuster changes the driving frequency to the predetermined compensation frequency smaller than the driving frequency in response to the frequency control signal.

4. The display apparatus of claim 3, wherein the frequency adjuster changes the frequency of the image data and the image control signal such that the display is driven at a transition frequency during a predetermined transition period before changing the driving frequency to the predetermined compensation frequency and outputs the changed image data and the image control signal.

5. The display apparatus of claim 4, wherein the transition frequency is greater than the predetermined compensation frequency and smaller than the driving frequency.

6. The display apparatus of claim 2, wherein, when the counted value is equal to or smaller than the predetermined reference value, the outputting unit outputs the frequency control signal including a second information to maintain the driving frequency, and the frequency adjuster maintains the driving frequency in response to the frequency control signal.

7. The display apparatus of claim 2, wherein the display comprises a plurality of unit pixels, each of the plurality of unit pixels comprises the first, second, and third pixels, and the first, second, and third pixel data are red, green, and blue pixel data, respectively.

8. The display apparatus of claim 2, wherein the hue data are data within first to third hue scale ranges, and the predetermined reference data are set to one or more in each of the first to third hue scale ranges.

9. The display apparatus of claim 8, wherein each of the first to third hue scale ranges is divided into a predetermined number of reference ranges, and the predetermined reference data are set in every reference range.

10. The display apparatus of claim 9, wherein the comparing/determining unit determines which section the hue data are located in among the reference sections and compares the hue data to the predetermined reference data set in a corresponding reference range among the reference ranges.

11. The display apparatus of claim 8, wherein reference frequencies set in the reference ranges have different frequencies from each other.

12. The display apparatus of claim 1, further comprising an optical characteristic compensator which compensates for an optical characteristic of the changed image data.

13. The display apparatus of claim 12, wherein the optical characteristic compensator is disposed between the frequency adjuster and the driver to apply the compensated image data to the driver.

14. A display apparatus comprising:

a display comprising first, second, and third pixels to display an image comprising color information;

a frequency compensator which receives first, second, and third pixel data respectively corresponding to the first, second, and third pixels, converting the first, second and third pixel data to hue data, and outputs a frequency control signal to change a current driving frequency (hereinafter, referred to as a driving frequency) of the display based on the hue data;

a frequency adjuster which changes the driving frequency to a predetermined compensation frequency in response to the frequency control signal and changes a frequency of image data and an image control signal to output the changed image data and the changed image control signal such that the display is driven at the predetermined compensation frequency; and a driver which receives the changed image data and the changed image control signal and drives the display at the predetermined compensation frequency; and an optical characteristic compensator which compensates for an optical characteristic of the changed image data, wherein the optical characteristic compensator comprises a look-up table that stores a compensation value corresponding to the predetermined compensation frequency, and the optical characteristic compensator compensates for the changed image data based on the compensation value.

15. The display apparatus of claim 1, further comprising:

a main board which receives and processes various control signals and image signals from an external peripheral device; and a display board connected to the main board and comprising a circuit used to drive the display.

16. The display apparatus of claim 15, wherein the frequency adjuster is disposed in the main board, and the frequency compensator and the driver are disposed in the display board.

17. The display apparatus of claim 15, wherein the frequency compensator and the frequency adjuster are disposed in the main board, and the driver is disposed in the display board.

18. A method of driving a display apparatus comprising a display comprising first, second, and third pixels to display an image having color information, the method comprising:

receiving first, second, and third pixel data respectively corresponding to the first, second, and third pixels to convert the first, second, and third data to hue data;

outputting a frequency control signal to change a current driving frequency of the display based on the hue data;

changing the current driving frequency to a predetermined compensation frequency in response to the frequency control signal and changing a frequency of image data and an image control signal to output the changed image data and the changed image control signal such that the display is driven at the predetermined compensation frequency; and receiving the changed image data and the changed image control signal to drive the display at the predetermined compensation frequency, wherein the hue data is generated based on a ratio of the first, second, and third pixel data.

19. The method of claim 18, wherein the outputting the frequency control signal comprises:

comparing the hue data to predetermined reference data to count up a number of the hue data greater than the predetermined reference data; and outputting the frequency control signal to change the current driving frequency when the counted value is equal to or greater than a predetermined reference value.

20. The method of claim 19, wherein, when the counted value is equal to or greater than the reference value, the frequency control signal is outputted to decrease the current driving frequency.

* * * * *